US009890787B2

(12) United States Patent
Bertoneri et al.

(10) Patent No.: US 9,890,787 B2
(45) Date of Patent: Feb. 13, 2018

(54) WET GAS COMPRESSOR AND METHOD

(71) Applicant: Nuovo Pignone Srl, Florence (IT)

(72) Inventors: Matteo Bertoneri, Castelnuovo Magra (IT); Massimo Camatti, Serravalle Pistoiese (IT); Manuele Bigi, Calenzano (IT); Luigi Podesta, Florence (IT)

(73) Assignee: Nuovo Pignone Srl, Florence (IT)

( * ) Notice: Subject to any disclaimer, the term of this patent is extended or adjusted under 35 U.S.C. 154(b) by 380 days.

(21) Appl. No.: 14/408,931

(22) PCT Filed: Jun. 18, 2013

(86) PCT No.: PCT/EP2013/062653
§ 371 (c)(1),
(2) Date: Dec. 17, 2014

(87) PCT Pub. No.: WO2013/189945
PCT Pub. Date: Dec. 27, 2013

(65) Prior Publication Data

US 2015/0322952 A1 Nov. 12, 2015

(30) Foreign Application Priority Data

Jun. 19, 2012 (IT) ..... FI2012A0125

(51) Int. Cl.
*F04D 29/30* (2006.01)
*F04D 15/00* (2006.01)
(Continued)

(52) U.S. Cl.
CPC ..... *F04D 15/0066* (2013.01); *F04D 1/00* (2013.01); *F04D 13/06* (2013.01);
(Continued)

(58) Field of Classification Search
CPC .. F04D 15/0066; F04D 15/0236; F04D 17/12; F04D 27/004; F04D 29/2216;
(Continued)

(56) References Cited

U.S. PATENT DOCUMENTS 1,688,345 A * 10/1928 Mursch ..... F04D 29/289 415/203
2,737,898 A * 3/1956 Andermatt ..... F04D 29/2216 415/76

(Continued)

FOREIGN PATENT DOCUMENTS

CN 102119052 A 7/2011
EP 1961969 A2 8/2008

(Continued)

OTHER PUBLICATIONS

Unofficial English translation of Office Action issued in connection with corresponding RU Application No. 2014149670 dated Aug. 12, 2016.

(Continued)

*Primary Examiner* — Ninh H Nguyen
(74) *Attorney, Agent, or Firm* — GE Global Patent Operation

(57) ABSTRACT

A centrifugal compressor for processing a wet gas. The centrifugal compressor includes: a casing; and least one compressor stage comprising at least one impeller rotatingly arranged in the casing and provided with an impeller hub and a plurality of impeller blades, each impeller blade having a suction side and a pressure side. The at least one compressor stage comprises at least one droplet breaking arrangement configured for promoting breakup of liquid droplets flowing through the compressor stage.

28 Claims, 7 Drawing Sheets

(51) Int. Cl.

| | |
|---|---|
| ***F04D 1/00*** | (2006.01) |
| ***F04D 13/06*** | (2006.01) |
| ***F04D 27/00*** | (2006.01) |
| ***F04D 15/02*** | (2006.01) |
| ***F04D 29/28*** | (2006.01) |
| ***F04D 29/24*** | (2006.01) |
| ***F04D 29/42*** | (2006.01) |
| ***F04D 31/00*** | (2006.01) |

(52) U.S. Cl.
CPC ..... *F04D 15/0236* (2013.01); *F04D 27/004* (2013.01); *F04D 29/242* (2013.01); *F04D 29/284* (2013.01); *F04D 29/286* (2013.01); *F04D 29/289* (2013.01); *F04D 29/30* (2013.01); *F04D 29/4213* (2013.01); *F04D 31/00* (2013.01); *F05D 2210/13* (2013.01); *F05D 2240/304* (2013.01); *F05D 2240/305* (2013.01); *F05D 2250/51* (2013.01); *F05D 2260/14* (2013.01); *F05D 2260/95* (2013.01)

(58) Field of Classification Search
CPC .... F04D 29/242; F04D 29/284; F04D 29/286; F04D 29/30; F04D 29/4213; F04D 29/289; F05D 2210/13; F05D 2210/132; F05D 2240/304; F05D 2240/305; F05D 2250/51; F05D 2260/14; F05D 2260/95
See application file for complete search history.

(56) References Cited

U.S. PATENT DOCUMENTS

| | | | | | |
|---|---|---|---|---|---|
| 2,842,306 | A * | 7/1958 | Buchi | A47B 96/1408 | 417/247 |
| 3,027,845 | A * | 4/1962 | Gilman | F04D 29/24 | 415/204 |
| 3,904,308 | A * | 9/1975 | Ribaud | F04D 21/00 | 415/143 |
| 4,543,036 | A * | 9/1985 | Palmer | F04D 27/0246 | 415/1 |
| 4,695,224 | A * | 9/1987 | Lown | F04D 29/5846 | 415/116 |
| RE32,756 | E * | 9/1988 | Mowill | F04D 27/0246 | 415/161 |
| 6,174,131 | B1 * | 1/2001 | Janson | F04D 17/122 | 415/179 |
| 6,273,674 | B1 | 8/2001 | Charron | | |
| 6,364,607 | B2 * | 4/2002 | Nagaoka | F04D 29/2216 | 415/208.2 |
| 6,773,235 | B2 * | 8/2004 | Poorte | F04D 31/00 | 417/1 |
| 8,047,509 | B2 * | 11/2011 | Towler | B01D 3/30 | 261/118 |
| 8,529,210 | B2 * | 9/2013 | Merritt | F04D 29/286 | 416/223 B |
| 8,727,736 | B2 * | 5/2014 | Walth | F04B 35/045 | 417/410.1 |
| 2011/0142607 | A1 | 6/2011 | Ciro et al. | | |

FOREIGN PATENT DOCUMENTS

| | | | |
|---|---|---|---|
| GB | 1140688 | A | 1/1969 |
| JP | 60173694 | U | 11/1985 |
| JP | H0237297 | U | 3/1990 |
| JP | H0560091 | A | 3/1993 |
| JP | H0526125 | U | 4/1993 |
| JP | 07119684 | A | 5/1995 |
| JP | 2001317495 | A | 11/2001 |
| JP | 2009191635 | A | 8/2009 |
| RU | 2396469 | C1 | 8/2010 |
| SU | 691607 | A1 | 10/1979 |
| WO | 9313318 | A1 | 7/1993 |
| WO | 2007089567 | A1 | 8/2007 |
| WO | 2011053278 | A1 | 5/2011 |

OTHER PUBLICATIONS

International Search Report and Written Opinion dated Sep. 27, 2013 which was issued in connected with PCT Patent Application No. PCT/EP13/062653 which was filed on Jun. 18, 2013.

Italian Search Report and Written Opinion dated Mar. 7, 2013 which was issued in connection with IT Patent Application No. FI2012A000125 which was filed on Jun. 19, 2012.

Unofficial English Translation of Chinese Office Action issued in connection with corresponding CN Application No. 201380032393.8 dated Apr. 27, 2016.

Japanese Office Action issued in connection with corresponding JP Application No. 2015517731 dated Apr. 25, 2017.

* cited by examiner

Bag Breakup
Stripping Breakup
Catastrophic Breakup
Dx
D
d
Vg
Vl 100
103
105
107
109
111
113

WET GAS COMPRESSOR AND METHOD

FIELD OF THE INVENTION

The embodiments disclosed herein generally relate to centrifugal compressors, and more particularly to compressors for processing a wet gas and components thereof. The embodiments of the present disclosure further relate to methods for operating a centrifugal compressor for processing a working fluid containing a liquid phase and a gaseous phase, i.e. a wet gas.

BACKGROUND OF THE INVENTION

A compressor is typically used to boost the pressure in a working fluid by receiving power from a prime mover, e.g. an electric motor or a turbine and applying a compressive force to the working fluid. The working fluid can be a gas, such as air or carbon dioxide, a refrigerant or the like. In some applications, the working fluid is a wet gas. A wet gas is understood as being a gas containing a fraction of a liquid phase, for example in form of droplets or aerosol.

Contaminants, in particular liquid contaminants in the form of liquid droplets in the intake gas flow can cause mechanical failures of the centrifugal compressor. Liquid droplets may accumulate in a stream of gas by condensation as the gas impacts surfaces within the compressor. The liquid droplets can hit the rotating parts of the compressor, in particular the compressor impeller, collide with each other and form larger droplets. A portion of the larger droplets is likely to continue in the gas flow direction of the compressor, while a remaining portion of those larger droplets sticks to the rotating impeller surface. The larger droplets remaining on the impeller surface will coalesce with new droplets impacting the impeller surface and this will increase the dimension of the droplets. Larger droplets will eventually be entrained by the gas flow and represent a high erosive potential risk. Moreover, the liquid film forming on the blade surface of the impeller can become unstable and lead to formation of droplets of larger size that are potentially very harmful from the view point of erosion.

In order to reduce the amount of liquid phase in a wet gas flow before entering a centrifugal compressor, a scrubber is usually provided. FIG. 1 illustrates schematically a compressor arrangement using a scrubber to process a wet gas. The arrangement is indicated with the reference number 1 as a whole. The compressor arrangement 1 comprises a centrifugal compressor 3 provided with a plurality of compressor stages 5. Each compressor stage 5 comprises a compressor impeller 7. The compressor impellers 7 are supported by a common rotor shaft 9 in a casing 11 of the centrifugal compressor 3. A wet gas flow entering at 13 is firstly processed through a scrubber 15. In the scrubber 15, the liquid phase is separated as a liquid condensate in the bottom of the scrubber 15 and removed therefrom through a liquid or condensate pipe 17. The gaseous phase is delivered from the top of the scrubber 15 through a dry gas pipe 19 towards the inlet of the compressor 3. Compressed gas is delivered from a discharge pipe 21, while the liquid phase is delivered by the liquid or condensate pipe 17 to a pump 23 and through a delivery pipe 25. Depending on the kind of application, liquid and gas phases can be then rejoined and combined in a wet flow discharge pipe 27.

FIG. 2 illustrates a prospective view of a compressor 3 of the prior art, with a portion of the casing removed, showing the inner components of the compressor. In the representative prior art centrifugal compressor 3 illustrated in FIG. 2 five compressor stages are provided, each comprising a respective impeller 7. A different number of stages can be employed.

FIG. 3 is a schematic cross-section along the longitudinal axis of the centrifugal compressor 3 according to the prior art of FIG. 2. The cross section illustrates three compressor stages 5. The working medium flow enters the first compressor stage 5 through an inlet channel 19A and flows through the first impeller 7. The compressed gas exiting radially the impeller 7 of the first compressor stage 5 is delivered through a diffuser 31 and a casing bend 33 formed in the compressor casing 11. From there the gas flows further through a return channel 35 and a bend 37 into the subsequent impeller 7 of the downstream compressor stage and so on.

In some embodiments known from the prior art, in order to reduce problems connected to the accumulation and coalescence of liquid droplets in the compressor stages, droplet catchers are used. An example of such droplet catchers is disclosed in WO 2001/0053278. Droplet catchers require particularly complex machining of the impellers. The droplets removed from the main working medium flow must be removed from the compressor casing, and therefore a liquid removal system is required. These systems are complex and expensive. Moreover, removal of the liquid collected in the compressor casing often requires stopping the compressor.

This disclosure pertains to the need to more efficiently processing a wet gas in a centrifugal compressor, in order to remove or at alleviate at least one of the problems connected to the presence of the liquid droplets in the compressor stages.

SUMMARY OF THE INVENTION

Disclosed herein is a centrifugal compressor for processing a wet gas, i.e. a gas comprising a gaseous phase and a liquid phase, e.g. in the form of droplets dispersed in the gaseous phase. The compressor comprises at least one compressor stage with one impeller, wherein droplet break up is promoted by suitable structures arranged in said compressor stage. Breaking up droplets in the wet gas flowing through the compressor alleviates or removes drawbacks caused by the presence of relatively large droplets in the gaseous flow. In some circumstances a scrubber for removing the liquid phase from the wet gas delivered to the compressor can thus be dispensed with. In some embodiments a scrubber can still be provided, but special measures for catching droplets in the compressor can be dispensed with. In some embodiments, neither a scrubber nor droplet catchers are required. In general, promoting or enhancing droplet break-up simplifies the design and operation of the compressor. Measures for promoting droplet break-up can be provided in one or more compressor stages. In some embodiments, at least the first compressor stage is provided with such measures.

Specifically, disclosed herein is a centrifugal compressor for processing a wet gas, said centrifugal compressor being provided with at least one compressor stage comprising an impeller rotatingly arranged in a casing and provided with an impeller hub and a plurality of impeller blades, each impeller blade having a suction side and a pressure side. The compressor stage comprises at least one droplet breaking arrangement configured for promoting break up of liquid droplets flowing through the compressor stage.

According to some embodiments, the droplet breaking arrangement is configured to alter a speed of the liquid phase with respect to a speed of the gaseous phase in the wet gas flowing through said at least one compressor stage. Speed of a fluid is a vector entity, i.e. can be represented as a vector having a modulus and a direction. Altering the speed of the liquid phase can include modifying the modulus of the speed, leaving the direction unaltered. In other embodiments, the direction of the speed vector can be modified, maintaining the modulus constant. In yet further embodiments, both the modulus and the vector direction can be modified.

Modifying, i.e. altering the speed of the liquid phase with respect to the speed of the gaseous phase promotes the interaction between the two phases. The gaseous phase moves usually faster than the liquid phase. When relatively slow liquid droplets interact with a relatively fast moving gaseous flow, a droplet break up effect will be obtained. The dimension of the droplets will be reduced, preventing or reducing erosive damages caused by the droplets to the compressor components. The liquid phase does not require to be removed from the working fluid, but can be maintained therein, eliminating or reducing the need for a scrubber and/or for complex droplet catching arrangements. If such arrangements are maintained, the amount of liquid collected thereby will be less than in state-of-the-art compressors, making the compressor operation more efficient.

In some embodiments the droplet breaking arrangement comprises droplet diverters arranged on the pressure side of the impeller blades. The droplet diverters impart to liquid droplets moving along the pressure side thereof a speed component directed transversely to the main flow speed direction of the wet gas flowing across the impeller. At the same time the modulus of the droplet speed can be reduces. The alteration of the droplet speed increases the speed difference (maybe in both modulus and direction) causing a breaking up interaction between the gaseous phase and the liquid phase, thus reducing the mean dimension of the droplets.

According to some embodiments, the droplet diverters are arranged at least along the radial extension of the impeller blades, between an impeller inlet and an impeller outlet. One or more diverters can be provided along the pressure side of each blade. The number of diverters may be the same on each blade, but this is not mandatory. In some embodiments, a different number of droplet diverters can be provided on different blades belonging to the same impeller. For example the odd blades can have one droplet diverter and the even blades can have two droplet diverters.

In some embodiments, diverters are arranged at least at an outlet, i.e. at the trailing edge of the impeller blades. In this case the diverters cause a droplet speed alteration at the discharge side of the compressor impeller.

In some embodiments, the trailing edge of the impeller blades, i.e. the edge of the impeller at the impeller outlet or impeller discharge will define two different angles: a first angle on the pressure side and a second angle at the suction side of the impeller. The liquid phase mainly collects along the pressure side of the impeller, due to the higher density of the liquid phase with respect to the gaseous phase. Consequently, on the discharge side the liquid phase will be slowed down and diverted to interact with the gaseous flow. The interaction promotes droplet break up and thus reduction of the droplet dimension.

A droplet diverter can be any surface discontinuity on the pressure side of the blade, imparting a speed modification to the fluid flowing along the pressure side of the blade. For example, a droplet diverter can comprise a projection, a knob, a ridge or a bump on the pressure side of the blade. The diverter is designed to reduce as much as possible the negative effect of the diverter on the overall compressor efficiency.

In some embodiments, the droplet breaking arrangement comprises a plurality of intermediate auxiliary blades, positioned between consecutive impeller blades, said intermediate auxiliary blades extending between an impeller inlet and an intermediate position between the impeller inlet and an impeller outlet, said intermediate auxiliary blades being shorter than the impeller blades. The liquid phase moving along the pressure side of the intermediate auxiliary blades will eventually pass over the trailing edge of said intermediate auxiliary blades, i.e. the downstream edge with respect to the flow direction. This will cause a sudden speed alteration of the liquid phase flow.

In some embodiments, the speed of the liquid phase will be altered with respect to the speed of the gaseous phase by providing an impeller which has a larger radius in the area where the majority of the liquid phase will be accumulated. Due to its higher density, the liquid phase will accumulate on the hub side. In some embodiments, the hub of at least one impeller is designed with a smaller diameter than the shroud, so that at the impeller discharge, the gaseous phase will be accelerated to a higher speed than the liquid phase. The speed difference thus induced promotes droplet break up. In general terms the impeller diameter can vary from the blade root to the blade tip, so that the discharge speed in the impeller section where more liquid is likely to be accumulated (near the impeller root) will be lower than the discharge speed nearer to the blade tip, where the working fluid flow will contain only or almost only gas with no liquid droplets therein.

In some embodiments the surface of the impeller is machined to facilitate the collection of the liquid phase in those areas where the most of the liquid phase is expected, e.g. on the blade pressure side.

In general terms the compressor can comprise any number of compressor stages. The number of compressor stages may be higher than one. Each compressor stage comprises at least one impeller. If only one impeller is provided with droplet breaking arrangements, this will be the first impeller, i.e. the most upstream one with respect to the working fluid direction. The possibility is not excluded, of providing droplet breaking arrangements in more than just one impeller.

At least the first impeller is made of a highly erosive-resistant material (e.g. a nickel-based alloy), or covered with special coatings, or comprises hard material inserts.

Even though here above and in the detailed description below each droplet breaking arrangement is disclosed individually, it shall be understood that more than one droplet breaking arrangement can be implemented on one or on each compressor stage.

To reduce the droplet diameter at the impeller inlet, and thus reduce erosion of the impeller at the wet gas inlet, stationary and rotary axial blades can be arranged upstream of the impeller inlet.

According to some embodiments, in order to reduce the impact of liquid droplets against the surface of the impeller, at the inlet of one or more compressor stages a wet-gas flow swirling arrangement is provided, configured to generate a swirl in the wet-gas flow at the inlet of the compressor stage. In some embodiments the swirling arrangement comprises a tangential wet-gas flow inlet. This arrangement reduces the relative speed between the wet gas flow and the rotating impeller, thus reducing the mechanical erosion of the impeller caused by the impact with the liquid droplets.

In order to further reduce potential erosion risks due to the presence of the liquid phase in the working fluid processed by the compressor, according to some embodiment of the subject matter disclosed herein a speed control system is provided. The system can be configured to control the rotational speed of the centrifugal compressor as a function of the amount of liquid phase in the wet-gas flow delivered to the centrifugal compressor. The amount of liquid phase can be determined directly, using e.g. a two-phase flow meter. The wet gas flows through the two-phase flow meter before entering the compressor. The two-phase flow meter generates a signal which is a function of the amount of liquid phase in the wet-gas flow and said signal can be used to control the rotational speed of the compressor.

Direct measurement of the liquid amount in the wet gas flow is not mandatory. According to other embodiments, a parameter linked to the amount of liquid can be used. The presence of a liquid phase in the working fluid processed by the compressor increases the power required to drive the compressor into rotation. The amount of liquid can thus be determined based upon a parameter which is a function of the torque required to rotate the compressor or of the power absorbed by a prime mover, such as an electric motor or a turbine, which drives the compressor. For example, a torque meter can be used to measure the torque applied to the compressor shaft. Alternatively, the power absorbed by an electric motor driving the compressor can be measured. Being the voltage constant, the power absorbed by the motor can be determined as a function of the current absorbed by the motor. The rotational speed of the compressor can thus be modulated, i.e. controlled based on the resistive torque, or on the current absorbed by the motor to drive the compressor into rotation: If the torque or the current increases, indicating an increased amount of liquid in the wet gas entering the compressor, the speed is lowered to reduce potential erosive damages to the compressor.

According to a further aspect the present disclosure also specifically concerns a wet gas compressor, comprising a casing and at least one or more compressor stages arranged for rotation in the casing, and further comprising a speed control system, configured to control the rotational speed of the compressor as a function of the amount of liquid phase in the wet gas being processed, or of a parameter directly or indirectly linked to said amount of liquid phase.

Specifically, the disclosure concerns a compressor assembly comprising: a compressor; a prime mover driving the compressor into rotation, the prime mover being configured to drive the compressor at a variable rotational speed; a measurement arrangement, configured for measuring a parameter linked to the amount of a liquid phase in the wet gas delivered to said compressor; a controller arranged and configured for controlling the rotational speed of the compressor as a function of the parameter. A wet gas compressor with a speed control arrangement as disclosed above can be provided with a scrubber to remove part of the liquid phase in the wet-gas flow before entering the compressor. In further embodiments, in addition to or instead of a scrubber, the compressor can be provided with liquid droplet catchers, to remove the droplets from the gaseous flow processed by the compressor. In both cases, speed control can be useful to prevent or reduce harmful erosion effects in case of malfunctioning of the scrubber, if present, and/or in case of defective operation of the droplet catchers. Moreover, since the droplet catchers are arranged in the interior of one or more compressor stages, removal of the liquid droplets will anyhow be obtained downstream of the first portions of the impeller, e.g. downstream of the impeller eye. Reducing the rotation speed of the compressor in case of increased amount of the liquid phase will protect the first parts of the impeller from excessive erosion.

According to a further aspect, the present disclosure concerns a method of operating a centrifugal compressor for processing a wet gas, said method comprising the steps of: processing a wet-gas flow containing a liquid phase and a gaseous phase in at least one compressor stage comprising an impeller arranged for rotation in a compressor casing, the impeller comprising an impeller hub and a plurality of impeller blades, each impeller blade comprising a suction side and a pressure side; and breaking liquid phase droplets flowing through said impeller.

According to some embodiments, the method can comprise the step of altering a speed of the liquid phase with respect to a speed of the gaseous phase in the wet-gas flow being processed in the compressor stage.

The step of altering the speed can include the step of modifying the speed direction of the liquid phase with respect to the speed direction of the gaseous phase. According to further embodiments, the step of altering the speed of the liquid phase with respect to the speed of the gaseous phase can include the step of modifying the modulus of the speed. In still further embodiments, the step of altering the speed can comprise modifying both the modulus as well as the direction of the speed.

In some embodiments, altering the speed direction can be achieved by imparting a tangential speed component to the liquid phase at the outlet of the vanes of the impeller and/or in an intermediate position along the vane, between the vane inlet and the vane outlet.

A tangential speed component can be imparted to the liquid phase by providing different angles of inclination on the two opposite sides of the trailing edge of each blade, so that the liquid phase, which accumulates predominantly on the pressure side of the blade, will be diverted towards the opposed suction side of the adjacent blade. The liquid phase will thus collide with the gaseous flow, provoking or enhancing droplet break up.

According to improved embodiments of the method disclosed herein, said method can further include the step of generating a swirl in the wet gas flow at an inlet of said impeller. The swirling effect is such as to reduce the relative speed of the working fluid with respect to the rotating components of the compressor.

In further embodiments, the method according to the present disclosure can comprise the step of breaking up liquid droplets at an inlet of one or more compressor impellers, to prevent larger droplets to impact the rotating components of the turbomachinery and thus reduce the erosion impact.

Further embodiments of the method disclosed herein include a step of modulating, i.e. modifying the rotation speed of the compressor as a function of the amount of liquid phase in the wet-gas flow or of a parameter linked to said amount of liquid phase, reducing the rotation speed when the amount of liquid phase increases.

According to a further aspect the present disclosure relates to a method for operating a compressor processing a wet-gas flow, said method comprising the steps of: rotating the compressor at a rotational speed; measuring at least one parameter which is linked to the amount of a liquid phase in the wet gas delivered to the compressor; controlling the rotational speed of the compressor as a function of said parameter, e.g. reducing the rotational speed of the compressor if the amount of liquid increases.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS OF THE INVENTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
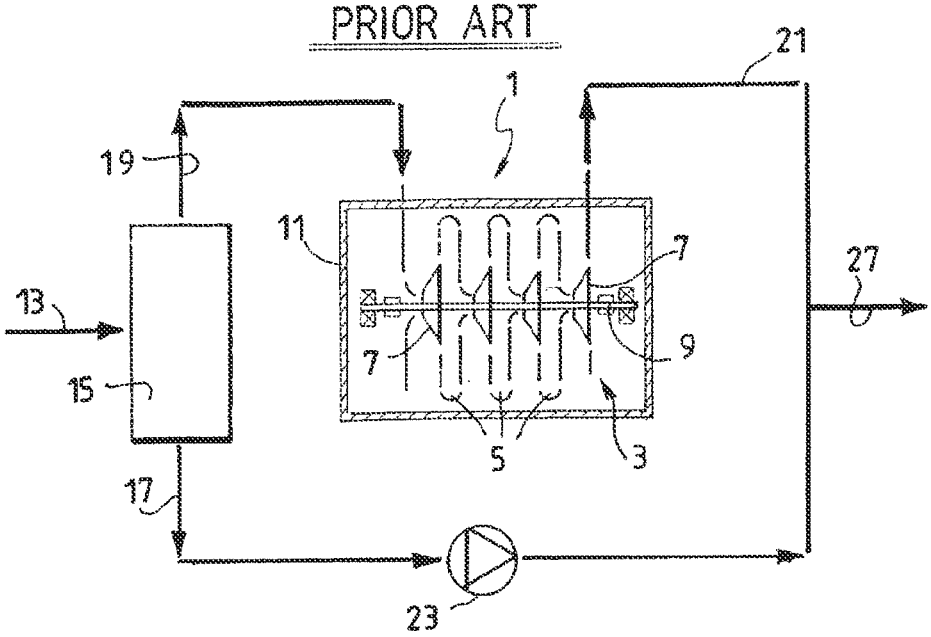
Fig. 1 PRIOR ART
FIG. 1 illustrates a schematic representation of a compressor arrangement according to the prior art, including a scrubber as describe here above.
Figure 2:
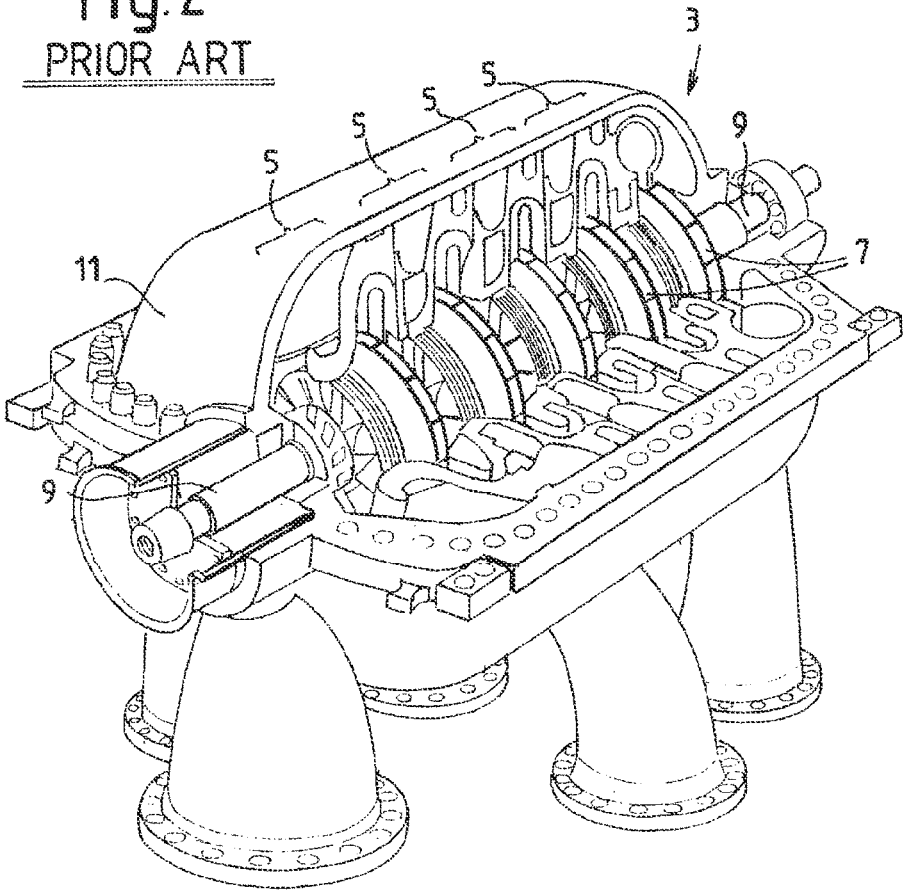
Fig. 2 PRIOR ART
FIG. 2 illustrates a perspective cut-out view of a representative prior art centrifugal compressor as describe here above.
Figure 3:
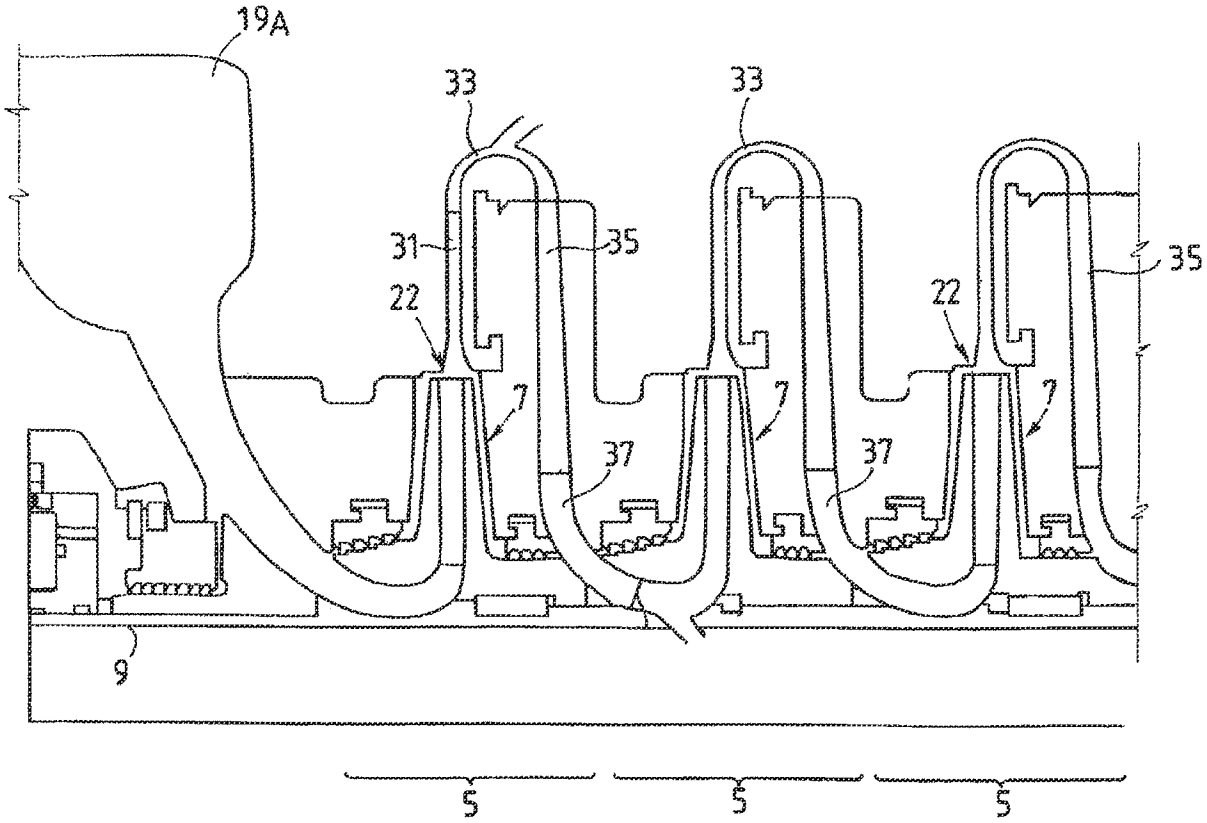
Fig. 3 PRIOR ART
FIG. 3 illustrates a simplified cross-section of the compressor of FIG. 2.
Figures 4, 5:
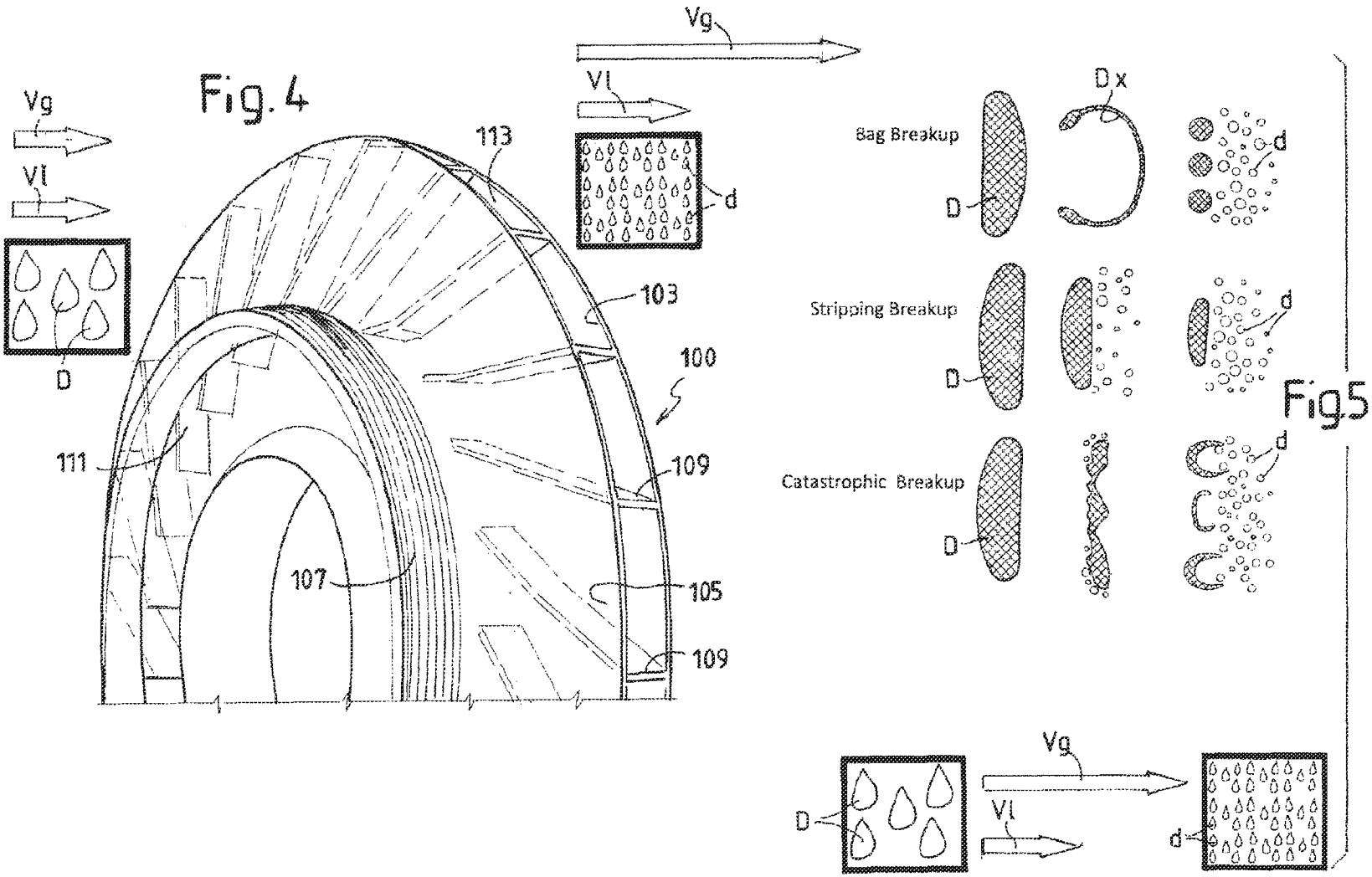
FIG. 4 diagrammatically represents the principle of operation of some of the embodiments disclosed herein.
FIG. 5 diagrammatically illustrates the break up process of large liquid droplets according to an embodiment of the invention.

FIG. 4 schematically illustrates the principle underlying the operation of some of the embodiments described in the present disclosure. In FIG. 4 a compressor impeller for a centrifugal compressor is schematically illustrated. Reference number 100 designates the impeller as a whole. In this schematic representation the impeller 100 is a shrouded impeller. The shrouded impeller 100 comprised an impeller hub 103, an impeller shroud 105 forming an impeller eye 107, and blades 109 arranged between the impeller hub 103 and the impeller shroud 105. 111 indicates the impeller inlet and 113 indicates the impeller outlet, i.e. the impeller discharge. In other embodiments the impeller can be open, i.e. not provided with a shroud.

The wet-gas flow entering the impeller inlet 111 contains droplets D as diagrammatically shown in FIG. 4. The droplets D represent the liquid phase of the wet gas. Reference V1 indicates the speed vector of the liquid phase, i.e. of the droplets D entering the impeller 100. Vg indicates the speed of the gaseous phase of the wet gas. Due to the higher inertia of the liquid phase, the speed V1 is usually slightly less than the speed Vg. When the gas flow enters the impeller 100, the speed difference increases due to the different inertia of the liquid phase and gas phase, respectively.

The speed difference between the two phases is used to provoke or promote break-up of the liquid droplets and reduce the volume of each droplet, so that their potential erosion effect on the components of the compressor is substantially reduced. FIG. 4 schematically shows that at the impeller discharge side the difference between the liquid phase speed V1 and the gaseous phase speed Vg is strongly increased. Due to this speed difference, the droplets forming the liquid phase are broken-up as shown schematically by the smaller dimension of the outlet droplets (labeled d) vis-à-vis the inlet droplets D.

FIG. 5 schematically illustrates possible mechanisms of droplet break up induced by the speed difference. On the right hand side of FIG. 5 three possible break up mechanisms are pictorially illustrated. The first break up mechanism is indicated as "bag break up". The gaseous flow impacts a larger droplet D and deforms it like a bag as indicated in DX until the bag finally bursts forming a plurality of smaller droplets d.

The second break up mechanism is indicated as "stripping break up". The gaseous flow impacts the larger droplet D and flows there through stripping smaller droplets d out of the larger droplet D.

The third breaking up mechanism, indicated as "catastrophic break up". The gaseous flow impacts a larger droplet D and causes the latter to blow up into a plurality of smaller droplets d.

According to some embodiments, at least the first impeller, i.e. the impeller of the first compressor stage (or the sole impeller, in case of one-stage compressor), is designed such as to improve or increase the droplet break up in the impeller, so that the dimension of the droplets flowing through the compressor is sufficiently small to avoid or limit erosive phenomena of the mechanical components of the compressor. In order to increase the droplet break up effect, measures are taken to modify or alter the speed of the liquid phase. It shall be understood that more than one impeller of the same multistage compressor can be designed to increase the droplet break up.

Figure 6:
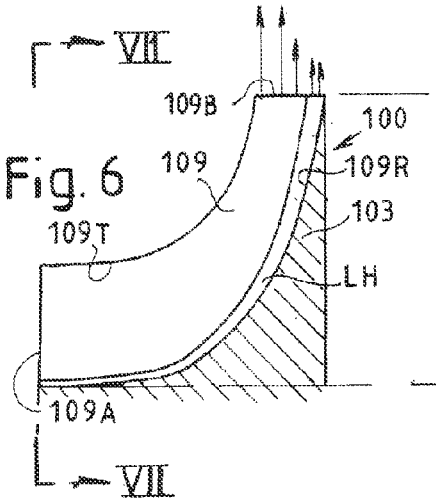
FIGS. 6 and 7 diagrammatically illustrate the way in which the liquid phase accumulates in a centrifugal compressor impeller in a cross-section and in a front view according to line VII-VII of FIG. 6, respectively.

FIG. 6 illustrates a schematic section along a plane containing the impeller axis. A single impeller blade 109 is illustrated in FIG. 6. The impeller blade 109 has a leading edge, or inlet edge 109A and a trailing edge, or outlet edge 109B. The impeller blade 100 develops from a root portion 103R, where the impeller blade 100 merges with the hub 103, towards a tip portion 109T. When the impeller 100 is a shrouded impeller, the tip portion 109T of the Due to the higher inertia of the liquid phase with respect to the gaseous phase, the liquid phase tends to accumulate in the area indicated with LH, on front surface of the hub 103, i.e. the surface of the hub 103 from which the blades 109 project.

Figure 7:
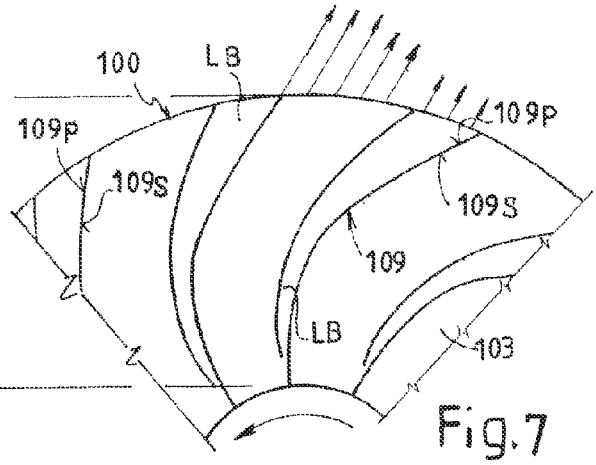

FIG. 7 illustrates a front view of the impeller 100, according to line VI-VI in FIG. 6. Each impeller blade 109 is schematically represented as a simple line, but it shall be understood that in actual facts the blades have a thickness, not represented in FIG. 7.

In FIG. 7 the pressure side and the suction side of the impeller blades 109 are indicated as 109P and 109S, respectively. Due to the higher inertia of the liquid phase with respect to the gaseous phase, the liquid phase tends to accumulate in LB on the pressure side 109P of each impeller blade 109.

The speed of the wet gas is not the same in the entire cross-section of a vane defined between two subsequent impeller blades 109. The gaseous phase has a higher speed and the liquid phase as a lower speed. In actual fact the flow speed is variable along the height of the vane and along the width of said vane, as indicated by the speed vectors schematically represented in FIGS. 6 and 7. The speed gradually diminishes moving from the tip region 109T towards the root region 109R when viewing the impeller in the cross-section of FIG. 6. Moreover, the speed reduces when moving from the suction side to the pressure side viewing the impeller in the front view of FIG. 7.

The speed difference between the liquid phase and the gaseous phase is exploited to promote droplet break up. In order to have a sufficient break up effect on the droplets present in the wet-gas flow, a droplet breaking arrangement is provided in at least the first impeller of the centrifugal compressor. The droplet breaking arrangement can have different configurations and be based on different phenomena. Some possible droplet breaking arrangements will be disclosed here below. Each arrangement described and illustrated in the drawings adopts one out of several possible features and measures to promote droplet break up. As will become apparent from the following description and as those skilled in the art of compressor designing will understand, two or more of the simple droplet breaking arrangements disclosed herein can be combined to form a more complex and possibly more efficient droplet breaking arrangement.

Figure 8:
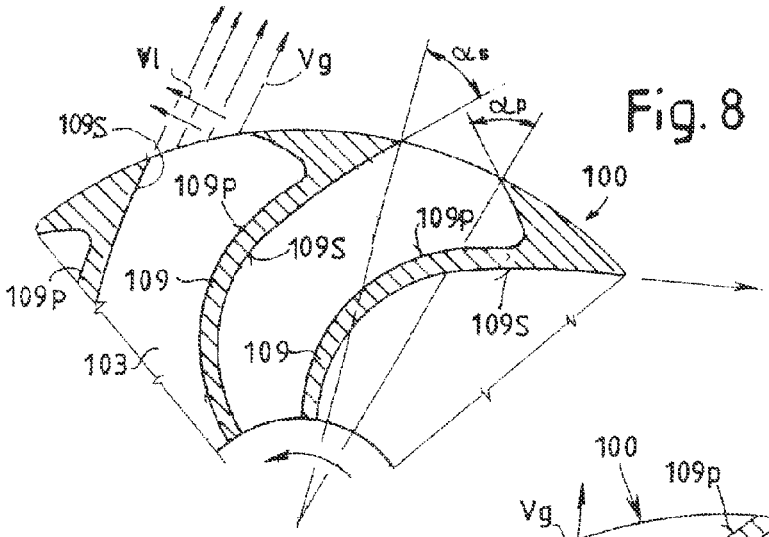
FIGS. 8, 9, 10, and 11 schematically illustrate embodiments of droplets breaking up arrangements.

FIG. 8 schematically illustrates a first embodiment of a droplet breaking arrangement according to the present disclosure. FIG. 8 represents a front view according to the axis direction of the impeller 100. The impeller 100 comprises impeller blades 109. According to this embodiment, the outlet or trailing edge portion of each impeller blade 109 is shaped such that the outlet angle, i.e. the discharge angle on the pressure side 109P of the impeller blade 109 is different from the discharge angle on the suction side 109S. The discharge angle is defined as the angle formed between the radial direction and the direction tangent to the trailing or discharge edge of the blade 109. In FIG. 8 the discharge angle on the pressure side of the blades 109 is indicated as $\alpha P$ and the discharge angle on the suction side of the blades 109 is indicated as $\alpha S$. The two angles are different from one another. The discharge angle represents the direction of the speed vector of the wet gas flowing out of the impeller 100. Consequently the mainly gaseous flow exiting along the suction side 109S of the impeller blade 109 has a speed Vg which differs in module and direction from the speed V1 of the liquid phase, which collects along the pressure side 109P of the blade 109. The module and direction differences between the two vector speeds enhance the break up effect on the liquid droplets.

Figure 9:
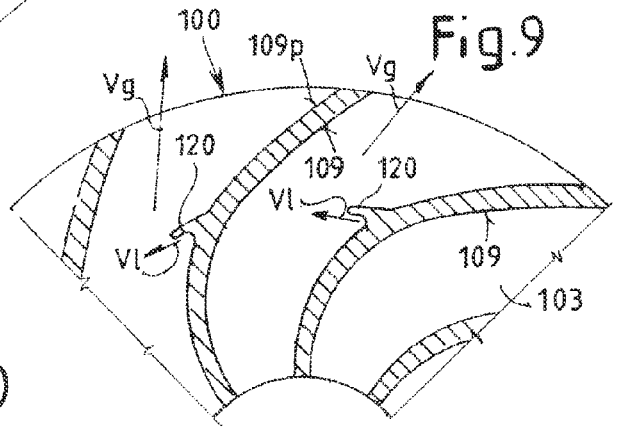

A different embodiment of a droplet breaking engagement is shown in FIG. 9. Here an impeller blade 100 is again shown in a front view. At least some, but possibly all, of the impeller blades 109 are provided with droplet diverters 120. These diverters can be in the form of projections extending from the respective impeller blades 109. Since, for the reasons discussed above, the liquid phase tends to accumulate on the pressure side 109P of the impeller blades 109, the droplet diverters 120 are arranged on the pressure side 109P of each impeller blade 109. As shown by way of example in FIG. 9, one or more droplet diverters 120 can be provided along the pressure side 109P of the impeller blades 109.

When the droplets moving along the pressure side 100P of the impeller blade 109 impact against a droplet diverter 120, they are diverted from the pressure side 109P towards the center of the respective vane of the impeller 100. The speed module and speed direction of the droplets is modified. The droplets are caused to move transversely to the speed direction of the gaseous phase in the vane between the two consecutive impeller blades 109. The speed difference (module and direction) between the gaseous phase and the liquid phase causes droplet break up.

Figure 10:
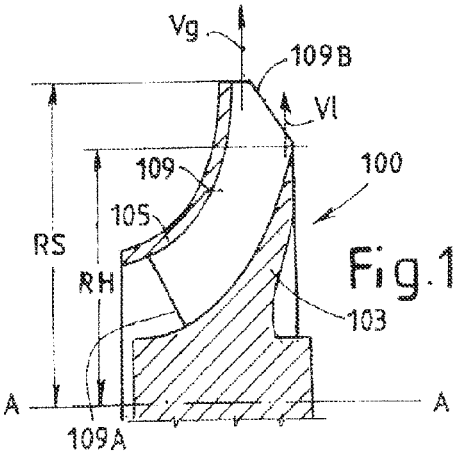

A further embodiment of a droplet breaking arrangement is schematically shown in FIG. 10, which illustrates an impeller 109 in a section along a plane containing the axis A-A of the impeller 100. The radius RH of the impeller hub 103 in this embodiment is smaller than the radius RS of the impeller shroud 105. If the impeller 100 is not shrouded, i.e. if no impeller shroud 105 is provided, the radius RS will represent the largest radius of the impeller blade 109, i.e. the radial dimension of the radially outmost point or tip of the discharge or trailing edge 109B of the blade 109.

The speed of the working medium flowing through the impeller 100 is determined by the speed of the impeller. The larger the impeller radius, the larger the discharge speed of the working medium. Since in the embodiment of FIG. 10 the radial dimension of the impeller 100 varies from the impeller hub to the impeller shroud, also the speed of the working medium at the impeller discharge side will vary from the impeller hub to the impeller shroud. More specifically, the speed of the working medium at the impeller discharge on the hub side will be smaller than the speed of the working medium at the impeller discharge in the area of the shroud. Since the liquid phase will tend to accumulate on the hub side, this difference in the radial dimension will provoke a speed difference between the liquid phase (speed V1) and the gaseous phase (speed Vg), the gaseous phase being accelerated to a substantially higher speed than the liquid phase. This speed difference provokes or enhances the droplet break up.

Figure 11:
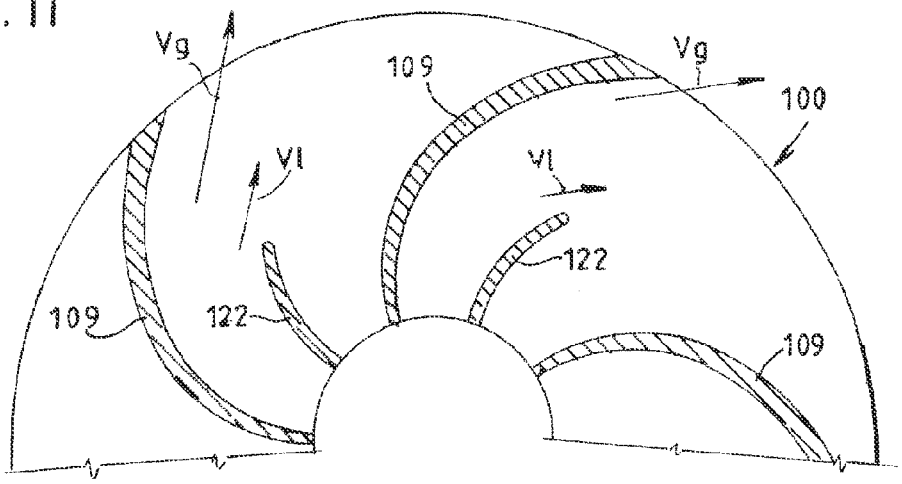

FIG. 11 illustrates a further embodiment of a droplet breaking arrangement. FIG. 11 illustrates a front view of the impeller 100 provided with a plurality of impeller blades 109. The impeller blades 109 extend from the impeller inlet 111 to the impeller outlet 113. Between each pair of sequentially arranged impeller blades 109 at least one intermediate auxiliary blade 122 is provided. Each intermediate auxiliary blade 122 is shorter than the impeller blades 109. This means that the intermediate auxiliary blades 122 develop from the impeller inlet 111 to an intermediate position along the vane between the respective impeller blades 109, without reaching the impeller outlet 113. Liquid droplets or a liquid film collecting on the pressure side of the intermediate auxiliary blade 122 will be mixed in the main flow of the working medium provoking droplet break up as soon as said liquid phase moving along the pressure side of the intermediate auxiliary blades 122 reaches the trailing edge 122B of the respective intermediate auxiliary blade 122.

It shall be understood that the four embodiments of droplet breaking arrangements described in connection with FIGS. 8 to 11 can be combined one with the other. For example, the arrangement of FIG. 8, based on a modification of the discharge angle so that the pressure side and the suction side of each blade have differing discharging angles, can be combined with the use of droplet diverters along the development of the impeller blades 109. The radial dimension difference between impeller hub and impeller shroud as disclosed with reference to FIG. 10 can also be combined with either one or the other or both of the arrangements of FIGS. 8 and 9 and in all said three arrangements intermediate auxiliary blades 122 can be additionally provided.

Figure 12:
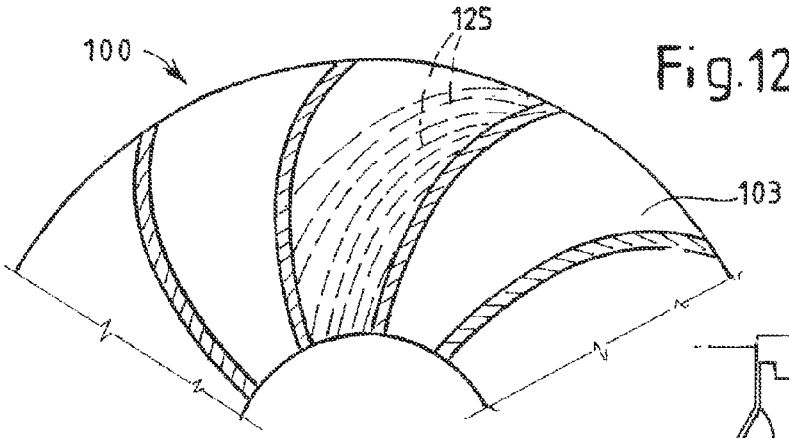
FIG. 12 illustrates a front view of a compressor impeller provided with grooves for promoting the collection of a liquid phase along the pressure side of the impeller blades according to an embodiment of the invention.

In order to increase the efficiency of the droplet breaking arrangement illustrated in FIG. 8 it would be useful to collect the largest possible amount of liquid phase on the pressure side of the impeller blades 109. In FIG. 12 a possible embodiment of the impeller 100 is illustrated, which improves the behavior of the impeller in that respect. On the hub side of the impeller 100, i.e. along the surface of the impeller hub 103 facing towards the inlet side of the impeller, grooves 125 are provided. These grooves develop generally from the inlet toward the outlet of the impeller 100 and are inclined with respect to the radial direction so that they will end along the pressure side of the respective impeller blades 109. Droplets collecting on the hub side of the impeller 100 will thus be guided by the grooves 125 towards the pressure side 109P of the impeller blades 109 and collect thereon, where the most effective droplet break up arrangement can be provide, reducing the amount of liquid phase moving along the hub side surface of the impeller 100.

Figure 13:
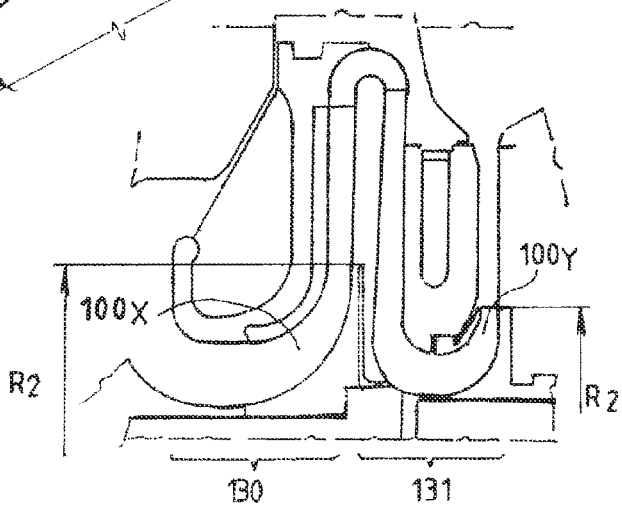
FIG. 13 illustrates a schematic cross-section of two sequentially arranged stages in a centrifugal compressor according to one embodiment of the subject matter disclosed herein.

FIG. 13 illustrates an embodiment in which two subsequently arranged compressor stages 130, 131, are designed with different radial dimensions. The first compressor stage 130 comprises a first impeller 100X and the second compressor stage 131 comprises a second impeller 100Y. The first impeller 100X has a radial dimension R1, greater than the radial dimension R2 of the second impeller 100Y of the second compressor stage 131. The two impellers rotate at the same angular speed, since they are supported on the same shaft. However, the peripheral speed at the outlet of the first impeller 100X is higher than the speed at the outlet of the second impeller 100Y due to the larger diameter of the first impeller with respect to the second impeller. Since droplet breaking up is mainly performed in the first compressor stage, designing the first compressor stage with a larger diameter will increase the efficiency of the droplet breakup. In fact, the speed difference between the liquid phase and the gaseous phase will be increased with increasing speed of the working fluid flowing through the compressor.

Use of a larger first compressor stage can be combined with one or more of the droplet breaking arrangements disclosed above.

Figure 14:
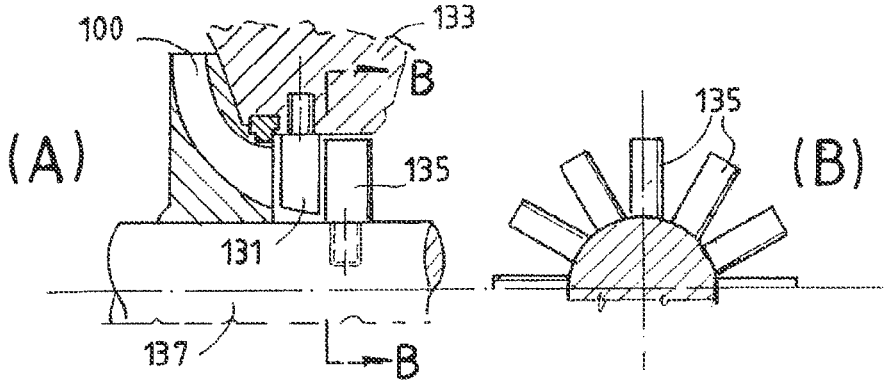
FIGS. 14A and 14B illustrate a cross-section and a front view, according to line XIV-XIV, of an axial stator and rotor blade arrangement at the inlet of a compressor stage, according to one embodiment of the subject matter disclosed herein.

In order to prevent the formation of a liquid layer at the inlet of the first compressor stage, according to possible embodiments an axial blade arrangement can be provided at the inlet of the first compressor stage. Such an embodiment is schematically shown in FIGS. 14A and 14B. Reference 100 again indicates the impeller of the first compressor stage. In front of the impeller inlet a set of stator blades 131 are arranged, fixed to the compressor casing 133. Upstream of the stator blades 131, with respect to the speed of the working fluid, a set of rotor blades 135 are arrange, said rotor blades 135 being constrained to the shaft 137 supporting the compressor impeller 100. FIG. 14B illustrates a front view according to line XIV-XIV of the set or rotor blades 135. The liquid droplets entering the compressor are mechanically broken up by the co-action of the stator blades 131 and the rotor blades 135. This breaking effect upstream of the first impeller can be useful to reduce the erosive effect of the droplets on the impeller eye and/or on the leading edge of the impeller blades of the first compressor impeller.

Figure 15:
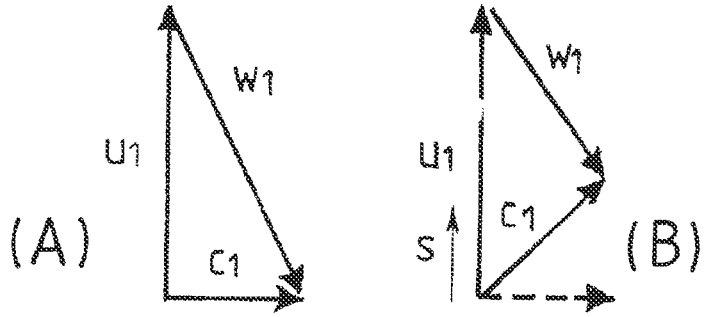
FIGS. 15A and 15B show a schematic vector representation of the inlet wet-gas flow speeds and the effect of a swirl generation arrangement on the flow speed according to an embodiment of the invention.

According to a further embodiment of the subject matter disclosed herein, the erosion of the impeller eye in the first compressor stage due to the presence of liquid droplets in the working fluid can be reduced by acting upon the wet gas speed at the inlet of the first impeller. FIG. 15A illustrates diagrammatically the vector speeds of the impeller (speed U1) and of the wet-gas flow (C1). The vector W1 represents the relative speed of the wet gas with respect to the impeller. The higher the relative speed, the higher is the erosive effect of the liquid droplets on the surfaces of the impeller, specifically the impeller eye and/or the leading edges of the impeller blades.

By introducing a swirl effect in the wet gas entering the impeller, the relative speed between the wet gas and the impeller will be reduced. This is shown schematically in FIG. 15B, where the same reference numbers are used to indicate the same speed vectors as in FIG. 15A. U1 again represents the speed vector of the impeller, C1 represents the speed vector of the incoming wet gas and W1 is the speed vector representing the speed of the wet gas relative to the impeller. By introducing a swirl component in the wet gas speed, represented by the vector S, the relative speed between the wet gas and the impeller, and therefore the erosive effect on the impeller, are reduced.

Figure 16:
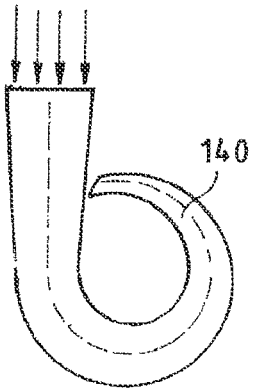
FIGS. 16 and 17 illustrate embodiments of swirl generating arrangements at the inlet of a compressor stage, or upstream of said inlet, e.g. at the inlet plenum.

This swirl effect can be introduced by using a tangential inlet as schematically illustrated in FIG. 16. The gas enters the first compressor stage with a speed direction which is non-orthogonal to the speed of the impeller, i.e. in a non-axial direction. This rotational motion is imparted by the spirally-shaped inlet channel 140 along which the wet gas is delivered into the first compressor stage.

Figure 17:
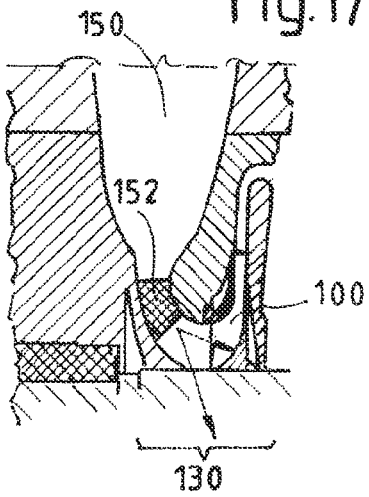

FIG. 17 illustrates a cross-section along a plane containing the axis of the compressor, of a different arrangement for generating a swirl effect in the wet gas flow. In this embodiment, an inlet duct 150 is provided upstream of the first compressor stage 130 where the first impeller 100 is arranged. An arrangement of fixed blades 152 is provided in the inlet duct 150. The fixed blades 152 are inclined so that a tangential speed component will be imparted to the wet gas entering the compressor stage 130.

The erosion effect of the liquid phase contained in the wet gas increases with increasing compressor speed, i.e. the higher the compressor rotational speed, the higher is the risk of erosive damages caused by liquid droplets in the working fluid.

According to further embodiment, in order to reduce the erosion effect of possible liquid droplets present in the wet-gas flow, the speed of the compressor is controlled such that the rotational speed of the impellers is reduced when the amount of liquid phase in the wet-gas flow increases.

Figure 18:
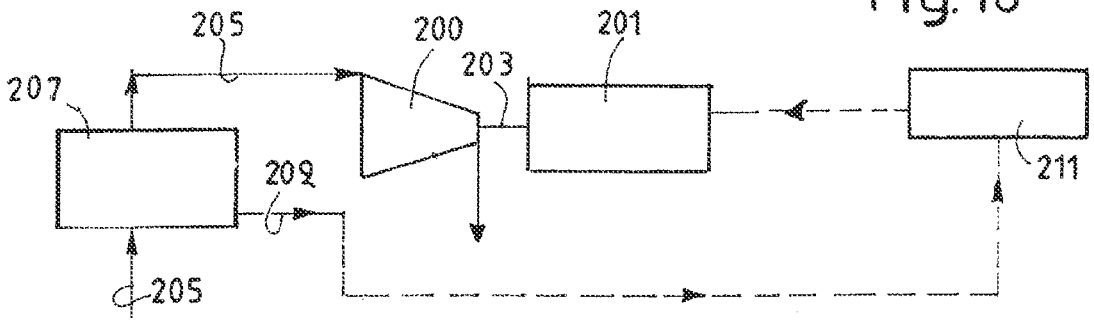
FIG. 18 illustrates a block diagram of a system for controlling the rotational speed of the compressor as a function of the amount of liquid phase in the wet-gas flow processed by the compressor according to an embodiment of the invention.

FIG. 18 illustrates a block diagram of a first embodiment of a system for controlling the compressor rotary speed as a function of the liquid content in the working fluid delivered to the compressor. In the schematic representation of FIG. 18 the compressor is indicated 200 as a whole. The compressor is driven into rotation by a mover, for example an electric motor 121. The electric motor 201 can be an electronically controlled, variable speed motor. A speed controller 211 can be provided for controlling the rotational speed of the electric motor 201 and of the compressor 200. A driving shaft 203 connects the electric motor 201 to the compressor 200. The wet gas is fed through an inlet duct 205. Along the duct 205 a two-phase flow meter 207 can be arranged. The two-phase flow meter 207 generates a signal which provides information on the amount of liquid phase flowing there through. The signal generated by the flow meter 207 is delivered (line 209) to the speed controller 211. The speed controller 211 in turn controls the speed of the motor 201 by reducing the rotational speed of the motor, and thus the rotational speed of the compressor 200, when the amount of liquid phase in the wet-gas flow delivered to the compressor 200 increases.

Figure 19:
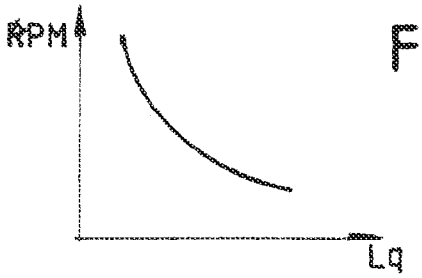
FIG. 19 illustrates a diagram of rotation speed vs. liquid content.

FIG. 19 schematically illustrates a diagram of the angular speed of the compressor (on the vertical axis) as a function of the liquid phase amount (Lq) in the working fluid, which amount is reported on the horizontal axis. The rotational speed of the compressor is reduced when the liquid amount increases. In the schematic example of FIG. 19 the rotational speed of the compressor 200 varies in a continuous, non-linear manner. Different control functions can be used, for example a stepwise variation of the rotational speed rather than a continuous variation can be envisaged. Additionally, the inclination of the curve can be different and can be for example linear.

Figure 20:
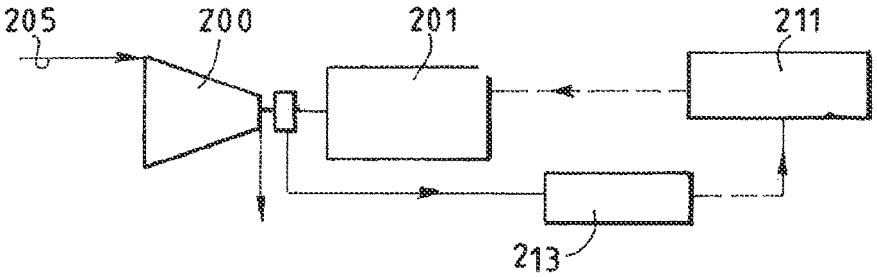
FIG. 20 illustrates a block diagram of a further embodiment of a system for controlling the rotational speed of the compressor as a function of the amount of the liquid phase in the wet gas flow.

FIG. 20 illustrates a block diagram of a different system for providing a speed control for the compressor, as a function of a parameter which is linked to the amount of liquid in the wet-gas flow delivered to the compressor. The same reference numbers indicate the same or equivalent parts as in FIG. 18. In this embodiment the amount of liquid is determined indirectly. The system is based on the recognition that the liquid phase present in the wet gas increases the torque which must be applied to the compressor rotor to maintain it into rotation. Therefore, an increasing amount of liquid phase in the wet-gas flow will increase the power needed to drive the compressor 200.

Figure 21:
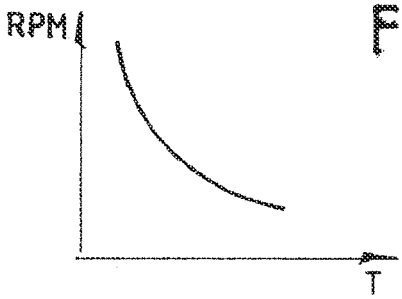
FIG. 21 illustrates a diagram of the rotational speed vs. torque in the system of FIG. 20.

The system shown in FIG. 20 is based on detection of the torque required to drive the compressor 200 into rotation. A torque meter 213 detects the torque applied by the motor 201 to the compressor shaft and the torque measured by the torque meter 213 is provided as an input signal to the speed controller 211. The signal can be conditioned before being delivered to the speed controller 211, if required. FIG. 21 illustrates the compressor rotational speed (on the vertical axis) as a function of the torque detected by the torque meter 213, reported on the horizontal axis (T). The rotational speed is controlled such as to be reduced when the measured torque increases, such increased torque being caused by an increased amount of liquid phase present in the wet gas delivered to the compressor 200.

The control can be continuums as shown in FIG. 21 or step wise. The inclination and the shape of the curve can be different from the one shown in FIG. 21, for example a linear curve can be used.

In further embodiments (not shown) different parameters can be used to control the rotational speed of the compressor as a direct or indirect function of the amount of liquid phase in the wet-gas flow. For example the current absorbed by the electric motor 201 can be used as a parameter, which is proportional to the torque required to drive the compressor into rotation, said torque being in turn proportional to the amount of liquid phase in the wet gas flow.

In general terms, the speed of the compressor is controlled so as to decrease the speed if an increasing amount of liquid in the two-phase flow is detected. In some embodiments, a threshold can be provided, representing a limit amount of liquid in the wet gas processed by the compressor. If the threshold is not exceeded, the compressor will be driven at a standard speed. If the amount of liquid (directly or indirectly measured) exceeds the threshold, the speed can be modulated, i.e. decreased gradually, as a function of the detected parameter linked to the amount of liquid in the working fluid.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A centrifugal compressor for processing a wet gas comprising a liquid phase and a gaseous phase, the centrifugal compressor comprising:

a casing;

at least one compressor stage comprising at least one impeller rotatingly arranged in the casing and provided with an impeller hub and a plurality of impeller blades, each impeller blade having a suction side and a pressure side;

wherein the at least one compressor stage comprises at least one droplet breaking arrangement configured for promoting breakup of liquid droplets flowing through the compressor stage, the least one droplet breaking arrangement comprises droplet diverters arranged on the pressure side of the impeller blades, the droplet diverters imparting to liquid droplets moving along the pressure side of the impeller blades a speed component directed transversely to a main flow speed direction of the wet gas flow across the impeller, and the impeller hub comprises a plurality of grooves disposed thereon between consecutive impeller blades, the grooves being configured to direct the liquid droplets towards the pressure side of each respective impeller blade.

2. The centrifugal compressor according to claim 1, wherein the at least one droplet breaking arrangement is configured to alter a speed of the liquid phase with respect to a speed of the gaseous phase in the wet gas flowing through the at least one compressor stage.

3. The centrifugal compressor according to claim 1, wherein the at least one droplet breaking arrangement is configured to modify the speed direction of the liquid phase with respect to the speed direction of the gaseous phase.

4. The centrifugal compressor according to claim 1, wherein the droplet diverters are arranged at least along a radial extension of the impeller blades, between an impeller inlet and an impeller outlet.

5. The centrifugal compressor according to claim 1, wherein the droplet diverters are arranged at least at an impeller-outlet end of the impeller blades.

6. The centrifugal compressor according to claim 1, wherein the at least one droplet breaking arrangement comprises a variable impeller outer diameter.

7. The centrifugal compressor according to claim 6, wherein each impeller blade has a root portion, a tip portion and a trailing edge at an outlet of the impeller, the trailing edge being inclined radially inwardly from the tip portion to the root portion.

8. The centrifugal compressor according to claim 6, wherein:

the impeller comprises an impeller shroud;

the impeller shroud has a diameter larger than a diameter of the impeller hub; and the impeller blades have a trailing edge extending from an outer shroud edge to an outer hub edge, the trailing edge of the impeller blades being inclined towards an impeller axis from the impeller shroud to the impeller hub.

9. The centrifugal compressor according to claim 1, further comprising a plurality of compressor stages, each compressor stage comprising a respective impeller, wherein the at least one compressor stage is comprised of the droplet breaking arrangement is the most upstream one of the plurality of compressor stages.

10. The centrifugal compressor according to claim 9, wherein the impeller of the most upstream compressor stage has a diameter larger than the subsequent compressor stages.

11. The centrifugal compressor according to claim 1, further comprising a plurality of stator axial blades and a plurality of rotor axial blades arranged at an inlet of the impeller of the at least one compressor stage.

12. The centrifugal compressor according to claim 11, wherein the stator axial blades are arranged downstream of the rotor axial blades with respect to a direction of flow of the wet gas.

13. The centrifugal compressor according to claim 1, wherein upstream of the at least one compressor stage a vaned swirled inlet plenum is arranged.

14. The centrifugal compressor according to claim 1, wherein at the inlet of the at least one compressor stage a wet-gas flow swirling arrangement is provided, configured to generate a swirl in the wet-gas flow at an inlet of the compressor stage.

15. The centrifugal compressor according to claim 14, wherein the wet-gas flow swirling arrangement comprises a tangential wet-gas flow inlet.

16. The centrifugal compressor according to claim 1, further comprising a speed control system configured to control a rotation speed of the centrifugal compressor as a function of an amount of the liquid phase in a wet-gas flow delivered through the centrifugal compressor.

17. The centrifugal compressor according to claim 16, wherein the speed control system comprises a two-phase flow meter, configured for detecting the amount of liquid phase in a wet-gas flow delivered to the centrifugal compressor, and a controller configured for controlling the rotation speed of the centrifugal compressor based on the detected amount of liquid phase in the wet-gas flow.

18. The centrifugal compressor according to claim 17, wherein the controller is arranged for controlling the speed of a variable-speed electric motor driving the centrifugal compressor.

19. The centrifugal compressor according to claim 16, wherein the speed control system comprise a device for detecting a parameter which is a function of a torque applied to a compressor shaft, and a controller configured for controlling the rotation speed of the centrifugal compressor based on the parameter.

20. The centrifugal compressor according to claim 1, wherein the impeller blades have a trailing edge forming a first discharge angle on the pressure side of the blade and a second discharge angle on the suction side of the blade, the first discharge angle and the second discharge angle being different from one another.

21. A method of operating a centrifugal compressor for processing a wet gas, the method comprising:

processing a wet-gas flow containing a liquid phase and a gaseous phase in at least one compressor stage comprising an impeller rotatingly arranged in a compressor casing, the impeller comprising an impeller hub and a plurality of impeller blades, each impeller blade comprising a suction side and a pressure side;

directing liquid phase droplets towards the pressure side of each respective impeller blade by a plurality of grooves disposed on the impeller hub and between consecutive impeller blades; and breaking the liquid phase droplets flowing through the impeller by imparting to the liquid phase droplets moving along the pressure side of the impeller blades a speed component directed transversely to a main flow speed direction of the wet-gas flow across the impeller.

22. The method according to claim 21, further comprising altering a speed of the liquid phase with respect to a speed of the gaseous phase in the wet-gas flow being processed in the compressor stage.

23. The method of claim 21, further comprising modifying the speed direction of the liquid phase with respect to the speed direction of the gaseous phase.

24. The method of claim 21, further comprising generating a swirl in the wet-gas flow at an inlet of the impeller.

25. The method of claim 21, further comprising breaking up liquid droplets at an inlet of the impeller.

26. The method of claim 21, further comprising providing a vaned swirled inlet plenum at an inlet of the at least one compressor stage and generate a vorticity in the wet-gas flow processed in the compressor stage.

27. The method of claim 21, further comprising modulating a rotation speed of the compressor as a function of the amount of liquid phase in the wet-gas flow, reducing the rotation speed when the amount of liquid phase increases.

28. A centrifugal compressor for processing a wet gas comprising a liquid phase and a gaseous phase, the centrifugal compressor comprising:

a casing;

at least one compressor stage comprising at least one impeller rotatingly arranged in the casing and provided with an impeller hub and a plurality of impeller blades, each impeller blade having a suction side and a pressure side;

wherein the at least one compressor stage comprises at least one droplet breaking arrangement configured for promoting breakup of liquid droplets flowing through the compressor stage, and the droplet breaking arrangement comprises a plurality of intermediate auxiliary blades, positioned between consecutive impeller blades, the intermediate auxiliary blades extending between an impeller inlet and a position between the impeller inlet and an impeller outlet, the intermediate auxiliary blades being shorter than the impeller blades.

* * * * *